United States Patent [19]

Kobayashi et al.

[11] Patent Number: 4,805,439

[45] Date of Patent: Feb. 21, 1989

[54] WORK FOLLOWING APPARATUS AND METHOD FOR PRESS WORKING

[75] Inventors: Shigeo Kobayashi; Osamu Yoshida; Haruo Saito; Tsutomu Shigeta; Hiroshi Nara; Shinji Abe; Kiyoharu Yamamoto, all of Tokyo, Japan

[73] Assignee: Oki Electric Industry Co., Ltd., Tokyo, Japan

[21] Appl. No.: 94,405

[22] Filed: Sep. 8, 1987

[30] Foreign Application Priority Data

| | | | |
|---|---|---|---|
| Sep. 5, 1986 | [JP] | Japan | 61-207815 |
| Dec. 5, 1986 | [JP] | Japan | 61-288916 |
| Mar. 17, 1987 | [JP] | Japan | 62-60053 |

[51] Int. Cl.[4] ..... B21D 11/22

[52] U.S. Cl. ..... 72/419; 72/386; 72/389; 72/701; 72/21

[58] Field of Search ..... 72/421, 389, 419, 420, 72/361, 386, 701, 21, 22, 24

[56] References Cited

U.S. PATENT DOCUMENTS

| | | | |
|---|---|---|---|
| 3,715,907 | 2/1973 | Hamdu | 72/419 |
| 3,855,840 | 12/1974 | Kawano | 72/389 |
| 4,114,418 | 9/1978 | Jarman | 72/419 |
| 4,753,100 | 6/1988 | Hanni | 72/389 |

FOREIGN PATENT DOCUMENTS

| | | | |
|---|---|---|---|
| 0100420 | 2/1984 | European Pat. Off. | 72/419 |
| 2343674 | 3/1975 | Fed. Rep. of Germany | 72/389 |
| 0037034 | 11/1975 | Japan | 72/389 |
| 0037035 | 11/1975 | Japan | 72/420 |
| 0041022 | 4/1981 | Japan | 72/419 |
| 0113932 | 6/1984 | Japan | 72/380 |
| 0064730 | 4/1985 | Japan | 72/389 |
| 1358832 | 7/1974 | United Kingdom | 72/420 |

*Primary Examiner*—David Jones

*Attorney, Agent, or Firm*—Wenderoth, Lind & Ponack

[57] ABSTRACT

A work following device for controlling the movement of the free portion of a work during a press working process such as a bending press working process to prevent the free portion of the work from warping due to the inertia thereof in the final stage of the press working process and for restoring the work to its initial position after the same has been pressed. The work following device having a base plate mounted with the components, a drum case fixedly disposed on the base plate and rotatably housing a drum, an electromagnet which holds to the free portion of a work during the press working process, an electromagnet holding member, a positioning block which positions the electromagnet holding member at a predetermined seating position at the start of the work following operation, an elongate spring plate having one end fixed to the drum and the other end fixed to the electromagnet holding member, and wound on the drum, a clutch connecting the drum to and disconnecting the drum from a reduction gear which is driven by a motor, and a control unit for controlling the operation of the components in accordance with a control program.

25 Claims, 16 Drawing Sheets

WORK FOLLOWING APPARATUS AND METHOD FOR PRESS WORKING

BACKGROUND OF THE INVENTION

1. Field of the Invention

The present invention relates generally to press working techniques and, more specifically, to a work following device and method for automatically following a work being pressed on a press such as a press brake.

2. Description of the Prior Art

In pressing a work, for example, a thin plate, on a press such as a press brake, the work needs to be positioned on the press accurately and the work needs to be held properly during the press working so that the work will not be deformed.

FIG. 18 illustrates a conventional press brake 1 in operation. The bending press 1 has a ram 2 which is lowered for press working, and a bed 5 provided with dovetail grooves 11. A movable bending die 3 is secured to the ram 2 with bolts 4, and a fixed bending die 6 is fixed in place on the bed 5 by means of holding bars 7, fulcrums 8, bolts 9 and nuts 10 using the dovetail grooves 11 of the bed 5.

In press working, a work 13 such as a flat plate is positioned accurately relative to the fixed bending die 6, and then a foot switch 14 is pressed to lower the ram 2, so that the work 13 is bent in a predetermined size between the movable bending die 3 and the fixed bending die 6. Then, the foot switch 14 is pressed again to raise the ram 2 to separate the movable bending die 3 from the fixed bending die 6. Then, the pressed work 13 is transferred from the bending press 1 to a delivery table, not shown. This press working cycle is repeated to bend works successively.

Problem occurs in bending the work 13 when the same is a comparatively large thin plate. Referring to FIG. 19, when such a comparatively large work 13 is pressed on the bending press 1 to bend one longitudinal side portion of the work 13, the opposite longitudinal side portion 13*a* of the same moves as indicated by an arrow as the work 13 is bent between the movable bending die 3 and the fixed bending die 6, in which the longitudinal side portion 13*a* is liable to move excessively by inertia to a position C beyond a normal position B and stops with a residual warp. To suppress such an undesirable movement of the longitudinal side portion 13*a*, the operator 12 is required to hold the longitudinal side portion 13*a* by hand to follow the movement of the longitudinal side portion 13*a* during the press working as illustrated in FIG. 18. Such a work is very dangerous to the operator 12.

To facilitate a press working and to eliminate such a dangerous manual work, in advanced press mills, an industrial robot for feeding a work to and removing a pressed work from a bending press, and a numerically controlled hydraulic work following apparatus which holds the work following the movement of the work during press working are employed in combination with a bending press. The work following apparatus positions a work fed by the industrial robot to the bending press accurately for press working, prevents the undesirable deformation of the work during press working and positions the pressed work accurately for removal by the industrial robot. However, the known work following apparatus requires a large floor space for installation in addition to a floor space for installing the bending press and has a complicated construction, which is disadvantageous in practical application of the work following apparatus.

SUMMARY OF THE INVENTION

Accordingly, it is an object of the present invention to provide a work following apparatus of a simple and compact construction capable of being installed on the bed of a press.

It is another object of the present invention to provide a work following apparatus capable of firmly holding a work during press working and of steadily following the work throughout the press working.

It is a further object of the present invention to provide a work following method for enabling a work following apparatus to operate and follow a work automatically throughout press working from the start of the press working.

According to one aspect of the present invention, a work following apparatus comprises; a work holding element such as an electromagnet which holds to a work; a work holding element holder holding the work holding element; a positioning block for positioning the work holding element holder; an elongate elastic member attached at one end thereof to the work holding element holder; a drum on which the elongate elastic member is wound with the other end thereof fixed to the drum; a drum case rotatably accommodating the drum; a clutch; a motor for driving the drum for rotation through a reduction gear an the clutch; a sensor for detecting the correct seating of the work holding element holder on the positioning block; and a base mounted with those components.

According to another aspect of the present invention, the free rotation of the drum is controlled by internal annular protrusions formed in the inner surface of the drum case so that the elongate elastic member wound on the drum will be unwound properly when the work holding element holding to the work rises together with the work and so that the work holding element holder is held in place on the positioning block after the same has been seated correctly on the positioning block by fully winding the elongate elastic member on the drum.

According to a further aspect of the present invention, the work holding element is held by means of a floating member on the work holding element holder so that the work holding element is able to hold to a work even if the work fed to the press is warped slightly.

The above and other objects features and advantages of the present invention will become apparent from the following description taken in conjunction with the accompanying drawings.

DESCRIPTION OF THE PREFERRED EMBODIMENTS

The preferred embodiments of the present invention will be described hereinafter as applied to a press brake with reference to the accompanying drawings.

First Embodiment

Figure 1:
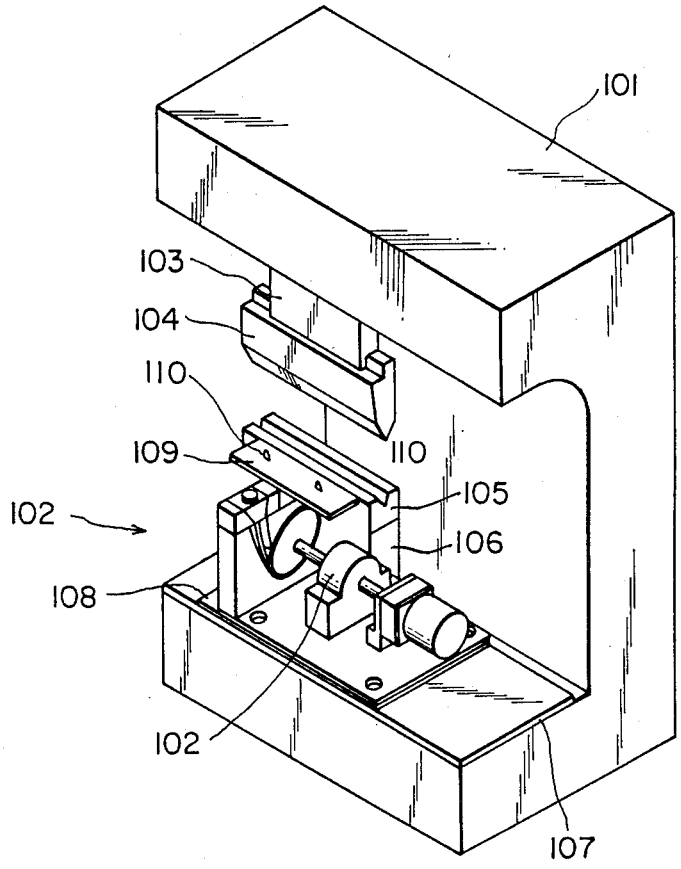
FIG. 1 is a perspective view showing the general appearance of a work following apparatus, in a first embodiment, according to the present invention mounted on a press brake.
Figure 5:
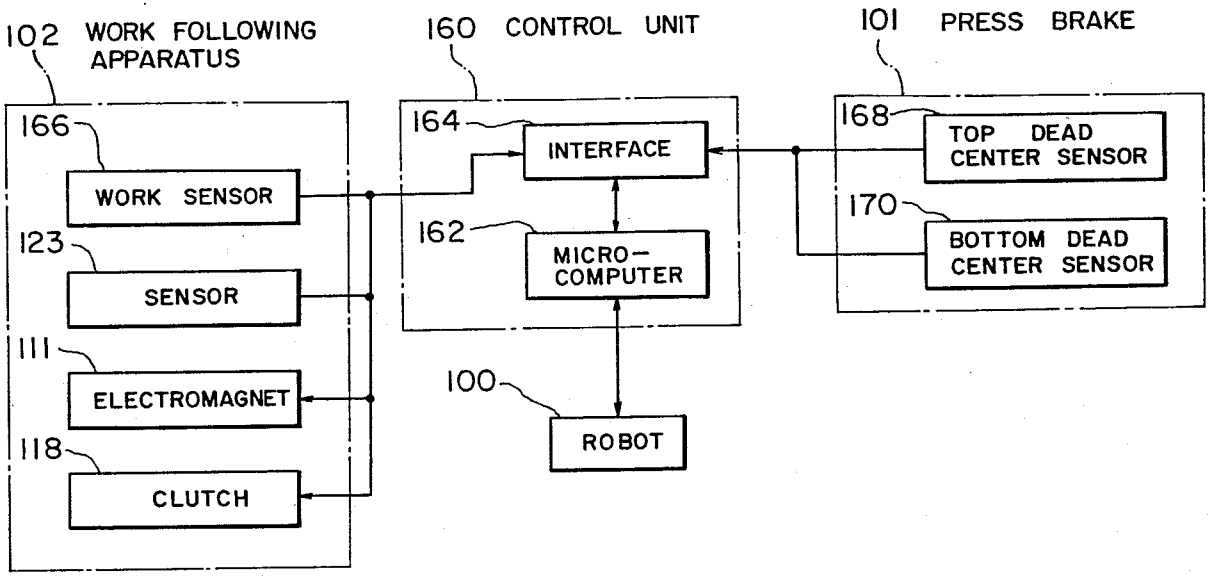
FIG. 5 is a perspective view similar to FIG. 2, showing a state of the work following apparatus of FIG. 1 when the ram is retracted after completing the bending press working, and the pressed work is returned to the original position.
Figure 6:
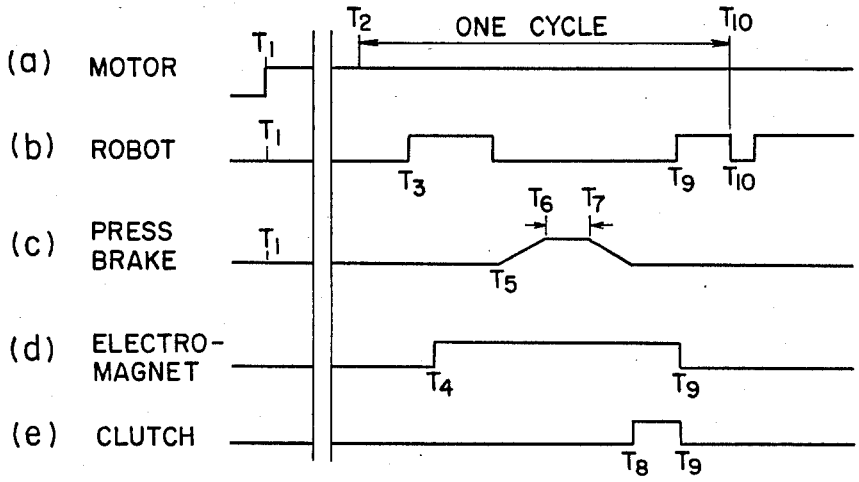
FIG. 6 is a block diagram showing a control unit for controlling the work following operation of the work following apparatus of FIG. 1.

Referring to FIG. 1, a work following apparatus 102, in a first embodiment, according to the present invention is installed on the bed 107 of a press brake 101 below the ram 103 of the press brake 101. A movable bending die 104 is secured to the ram 103, and a fixed bending die 105 is fixed to the bed 107 so as to mate with the movable bending die 104 when the ram 103 is lowered for press working. The fixed bending die 105 is supported on a spacing block 106 to provide a clearance for the work following apparatus 102. A work supporting table 109 is provided in front of the fixed bending die 105 to support a work 124 (FIG. 2), for example, a flat plate, fed to the press brake 101, for example, by an industrial robot 100 (FIG. 5). Positioning pins 110 are provided fixedly on the work supporting table 109 to position the work 124 placed thereon.

Figure 2:
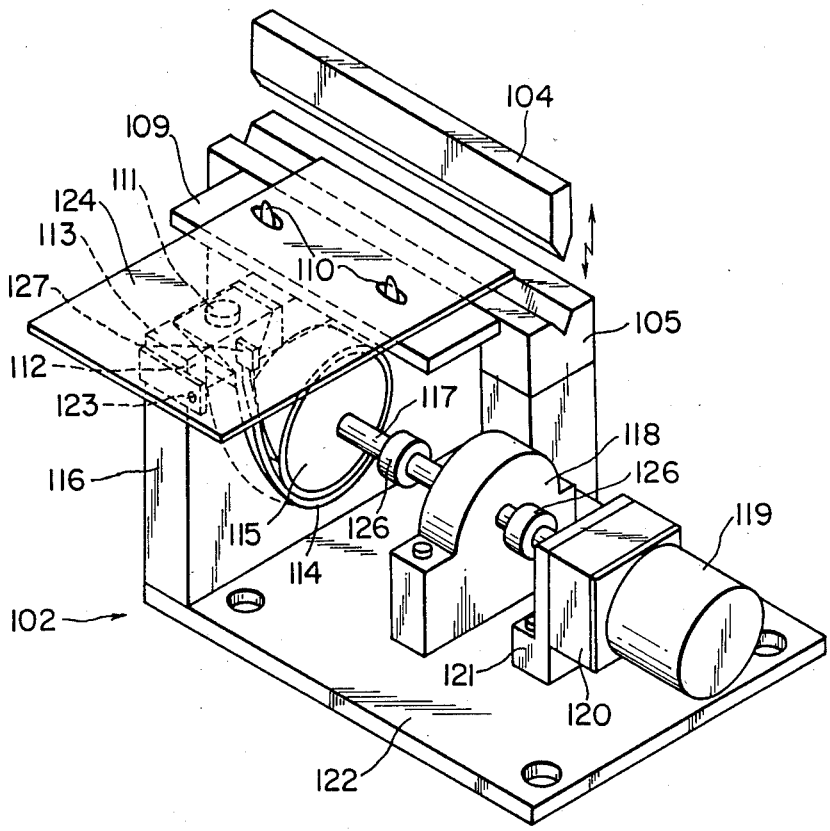
FIG. 2 is a perspective view of the work following apparatus of FIG. 1.
Figure 3:
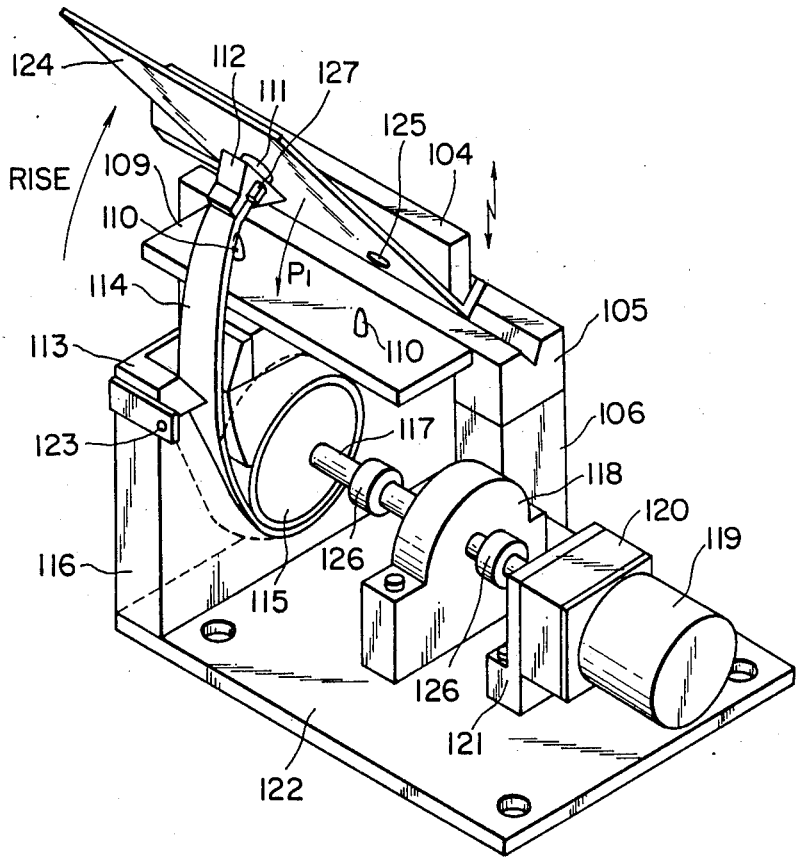
FIG. 3 is a perspective view, similar to FIG. 2, showing a state of the work following apparatus of FIG. 1 when a work is positioned for bending press working.
Figure 4:
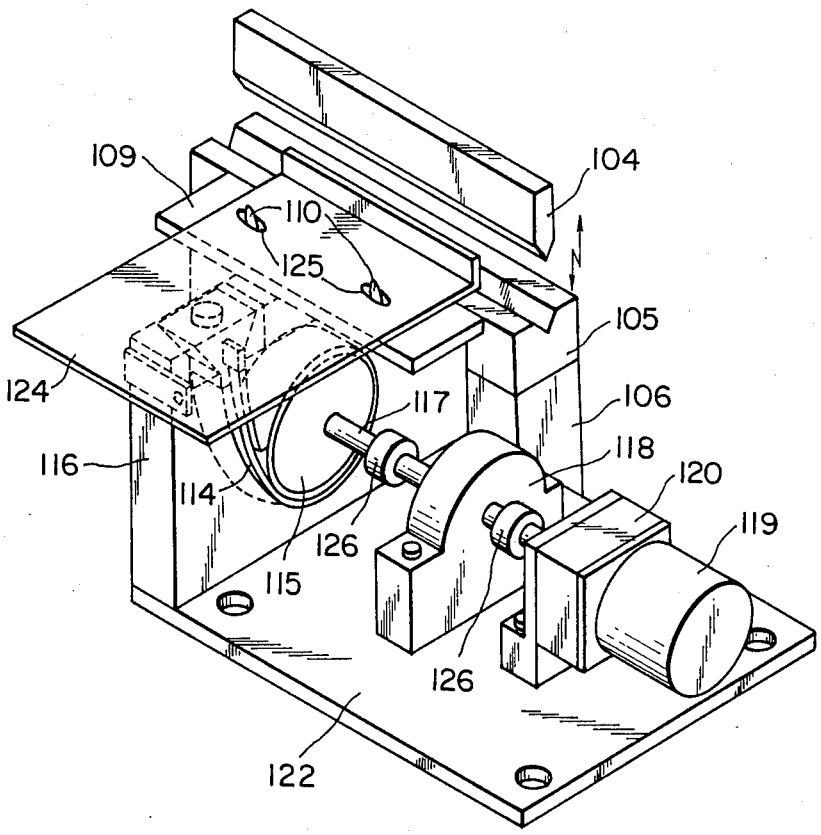
FIG. 4 is a perspective view similar to FIG. 2, showing a state of the work following apparatus of FIG. 1 when the ram of the press brake is lowered to the lowermost position to bend the work.

Referring to FIGS. 2 and 5, the work following apparatus 102 has an electromagnet 111, namely, a work holding means, which attracts and holds to the work 124, an electromagnet holder 112, namely, a work holding means holding member, holding the electromagnet 111, and a positioning block 113 for positioning the electromagnet holder 112 at a seating position. An elongate spring plate 114, namely, an elongate elastic member, has one end fixed to the electromagnet holder 112 and the other end fixed to a drum 115. The spring plate 114 is wound on and unwound from the drum 115. The drum 115 is supported rotatably within a drum case 116 fixed to a base plate 122. A first shaft 117 concentrically fixed to the drum 115 is connected to a first safety coupling 126 connected to the output shaft of a clutch 118 fixed to the base plate 122. The input shaft of the clutch 118 is connected through a second safety coupling 126 to an output shaft reduction gear 120. An input shaft of the reduction gear is connected to a motor 119 for driving the drum 115. The motor 119 and the reduction gear 120 are supported fixedly on a bracket 121 which in turn is fixed to the base plate 122. The correct seating of the electromagnet holder 112 on the positioning block 113 is confirmed through the detection of a lug 127 attached to the electromagnet holder 112 by a reflective photoelectric sensor 123.

Referring to FIG. 5, a control unit 160 for controlling the work following operation of the work following apparatus comprises a microcomputer 162 which processes input data according to predetermined control programs to control the respective operations of the press brake 101 and the work following apparatus 102, and an interface 164 connected to the microcomputer 162. The interface receives detection signals from the sensor 123, a work sensor 166 provided on the work supporting table 109 to detect the correct positioning of the work 124 on the work supporting table 109, a top dead center sensor 168 for detecting the arrival of the movable bending die 104 at the top dead center, and a bottom dead center sensor 170 for detecting the arrival of the movable bending die 104 at the bottom dead center, and then gives signals corresponding to the detection signals to the microcomputer 162. Then, the microcomputer 162 gives command signals to the electromagnet 111, the clutch 118, the industrial robot 100 and the press brake 101 according to the predetermined control programs to control the respective operations of the press brake 101, the work following apparatus 102 and the industrial robot 100.

The manner of operation of the work following apparatus thus constituted will be described hereinafter with reference to FIGS. 2, 3, 4 and 6 showing a state in which the work 124 is set in place on the press brake 101 with the electromagnet 111 holding to the work 124, a state in which the work 124 has been bent and the spring plate 114 is pulled out from the drum case 116, a state in which the movable bending die 104 is raised, the spring plate 114 is retracted into the drum case 116 and the work 124 is returned to the initial position after the bending press working has been completed, and a time chart of the respective operations of the motor 119, the industrial robot 100, the press brake 101, the electromagnet 111 and the clutch 118, respectively.

First, the motor 119 of the work following apparatus 102, the press brake 101 and the industrial robot 100 are connected to a power source at time $T_1$, consequently, the motor 119 is actuated and the press brake 101 and the industrial robot 100 are ready to operate upon the reception of command signals from the control unit 160. Then, the operating means of the control unit 160, such as a keyboard, is operated to give a program start command to the microcomputer 162 at time $T_2$. Then, industrial robot 100 starts operating from the home position at time $T_3$ to position the work 124 on the work supporting table 109 so as to receive the positioning pins 110 in positioning holes formed in the work 124, respectively. Then, the work sensor 166 gives a detection signal indicating the correct reception of the work 124 on the work supporting table 109 to the microcomputer 162. Then, the control unit 160 magnetizes the electromagnet 111 at time $T_4$ to attract the work 124 to the electromagnet 111. Upon the detection of the return of the industrial robot 100 to the home position, the control unit 160 gives a command signal at time $T_5$ to actuate the ram of the press brake 101 and thereby the movable bending die 104 is lowered to bend the work 124. The free longitudinal side portion of the work 124 rises as the opposite longitudinal side position of the work 124 is bent, and hence the electromagnet 111 rises together with the free longitudinal side portion of the work 124 pulling out the spring plate 114 from the drum case 116. During the bending process, the clutch 118 is kept disengaged to time $T_8$ and hence the drum 115 is free to rotate. Accordingly, only a frictional resistance of the drum case 116 acts on the spring plate 114 when the spring plate 114 is pulled out.

The movable bending die 104 arrives at the bottom dead center at time $T_6$ and held there for a predetermined time to time $T_7$. When the movable bending die 104 is raised after the completion of bending press working, the control unit engages the clutch 118 at time $T_8$ to connect the drum 115 to the motor 119 to start winding the spring plate 114 on the drum 115 to return the electromagnet holder 112 to the seating position on the positioning block 114. Thus, the electromagnet holder 112 is seated again on the positioning block 113 at the seating position and, at the same time, the work 124 is positioned again on the work supporting table 109 with the positioning holes receiving the positioning pins 110 therein, respectively. Upon the detection of the arrival of the electromagnet holder 112 at the correct seating position on the positioning block 113 by the sensor 123 at time $T_9$, the electromagnet 111 is demagnetized, the clutch 118 is disengaged and the industrial robot 100 is actuated again to transfer the pressed work 124 from the press brake 101 to a predetermined position. Then, the industrial robot 100 is returned to the home position at time $T_{10}$.

In case the electromagnet holder 112 failed to return to the correct seating position on the positioning block 113 for some trouble and the sensor 123 is unable to detect the lug 127 within a predetermined time, an alarm lamp, not shown, is lighted up, an alarm information is displayed, the clutch 118 is disengaged and the motor 119 is stopped.

The safety couplings 126, for example, helical couplings, are overload protectors, which break to protect the components of the work following apparatus 102 from overloading, when an excessive torque is applied thereto.

Although this embodiment employs the industrial robot 100 for automatically feed and position the work 124 on the work supporting table 109 and for automatically removing the pressed work 124 from the press brake 101, controls the operation of the press brake 101 and the work following apparatus 102 by the control unit on the basis of the detection signals provided by the sensors, such work need not necessarily be carried out automatically; the work 124 may be fed and positioned on the work supporting table 109, the pressed work 124 may be removed from the press brake 1 and the operation of the press brake 101 and the work following apparatus 102 may be controlled by means of manual switches (not shown) by an operator.

Furthermore, the electromagnet 111 may be substituted by a pneumatic or mechanical clamping means.

Still further, although the first embodiment has been described as employing a single electromagnet as a work holding means to simplify the explanation, a plurality of assemblies each of the electromagnet 111, the electromagnet holder 112, the positioning block 113, the spring plate 114, the drum 115 and the drum case 116 may be arranged on the first shaft 117 depending on the size and shape of the work to be pressed.

Although the first embodiment of the present invention has been described as applied to a press brake, naturally, the present invention is applicable to other presses.

Second Embodiment

The second embodiment is substantially the same as the first embodiment in constitution and function, and hence only parts and functions of the second embodiment different from those of the first embodiment will be described herein to avoid duplication.

Figure 7:
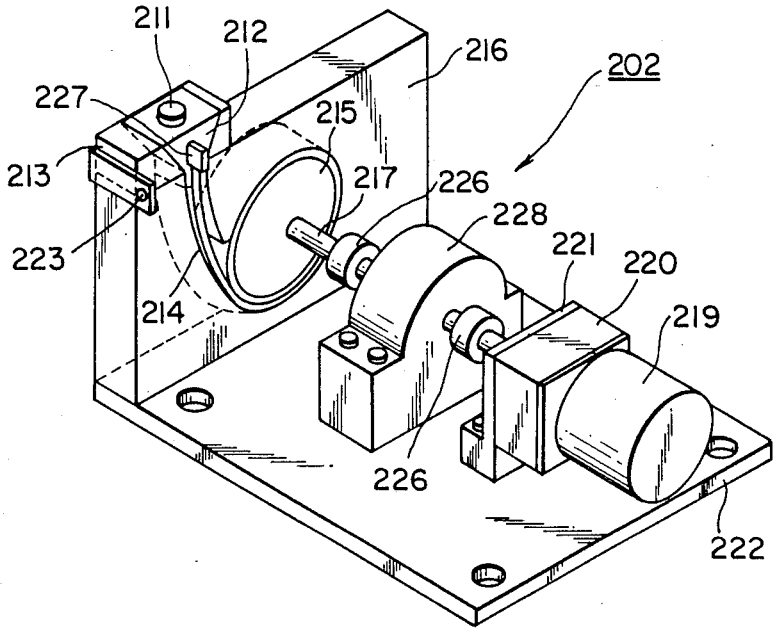
FIG. 7 is a time chart showing the sequential operation of the components of the work following apparatus of FIG. 1.
Figure 8:
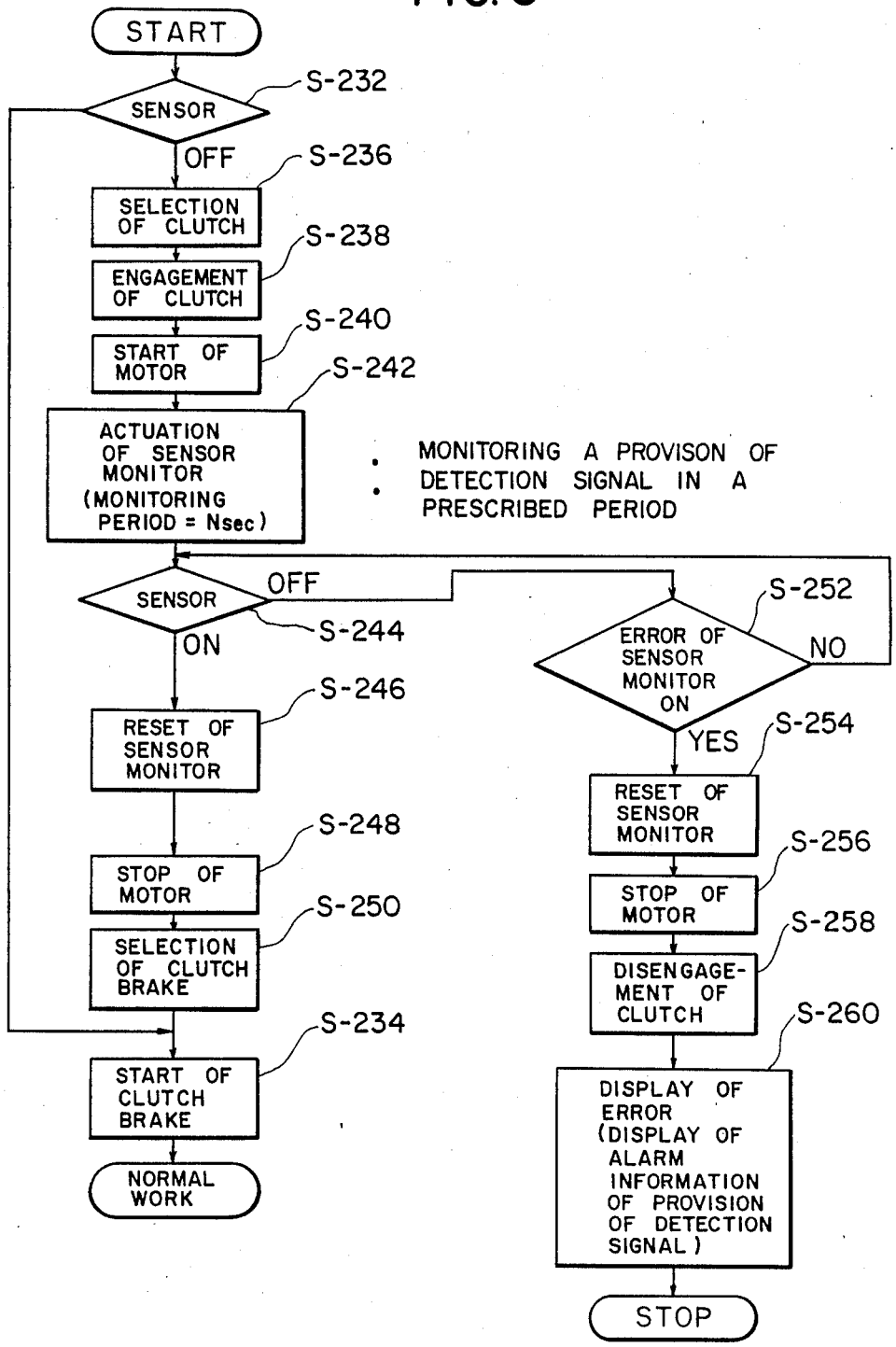
FIG. 8 is a flow chart showing steps of work following operation to be executed by a work following method in accordance with the present invention.

Referring to FIGS. 7 and 8, the second embodiment is provided with a clutch-brake unit 228, which corresponds to the clutch 118 of the first embodiment, and a sensor monitor for monitoring the detection signal of the sensor 223, and is capable of detecting and correcting the dislocation of the electromagnet holder 212 from the seating position on the positioning block 213 at the start of the work following operation. The clutch system and brake system of the clutch-brake unit 228 do not function simultaneously; while one of the systems is operative, the other remains inoperative.

In some cases, the electromagnet holder 212 is moved away from the correct seating position on the positioning block 213 by the resilience of the spring plate 214 urging the spring plate 214 to recoil against the frictional resistance of the drum case 216, after the electromagnet holder 212 has been seated on the positioning block 213 at the seating position. If the electromagnet holder 212 is not positioned correctly at the seating position, the work following apparatus 202 is unable to start automatically.

In the second embodiment, when the dislocation of the electromagnet holder 212 from the correct seating position is detected by the sensor 223 before starting the work following operation, the motor 219 is actuated automatically and operates for a predetermined time to wind the spring plate 214 further on the drum 215 so that the electromagnet holder 212 is seated correctly on the positioning block 213 at the seating position, and then the motor 219 is stopped and the brake system of the clutch-brake unit 228 is actuated simultaneously to check the rotation of the drum 215 in the unwinding direction.

The manner of work following operation of the second embodiment will be described hereinafter with reference to FIG. 8.

At the start of the work following operation, a decision is made, on the basis of the mode of the sensor 223, whether or not the electromagnet holder 212 is seated correctly on the positioning block 213 at the seating position in step 232. When the electromagnet holder 212 is seated correctly on the positioning block 213, the sensor 223 provides a detection signal. When the electromagnet holder 212 is seated correctly on the positioning block 213, the brake system of the clutch-brake unit 228 is applied to start the work following operation in step 234.

When the sensor 223 does not provide any detection signal, namely, when the electromagnet holder 212 is not seated correctly on the positioning block 213, the clutch system of the clutch-brake unit 228 is selected in step 236, and then the clutch system is engaged in step 238. Then, simultaneously, the motor 219 is started in step 240 and the sensor monitor is actuated in step 242. Consequently, the torque of the motor 219 is transmitted to the drum 215 to start winding the spring plate 214 on the drum 215. A decision is made in step 244 whether or not the sensor 223 has provided a detection signal within a predetermined monitoring period (in this embodiment, 1 sec) after the start of the motor 219. When the decision in step 244 is "Yes", namely, when the sensor 223 is ON and the detection signal is given, the sensor monitor is reset in step 246, and then the motor 219 is stopped in step 248. At the same time, the brake system of the clutch-brake unit 228 is selected in step 250 and the brake system is applied in step 234. Thus, the steps of the control operation from step 248 to stop the motor 219 to step 234 to apply the brake system of the clutch-brake unit 228 are executed successively, and hence there is no time for the spring plate 214 to rotate the drum 215 in the reverse direction. Consequently, the electromagnet holder 212 thus seated correctly on the positioning block 213 is held in place to permit the work following apparatus to start the normal work following operation.

In step 252, a decision is made whether or not time monitor error detector is on. When the decision in step 252 is "Yes", namely, when the sensor 223 does not provide any detection signal within the predetermined monitoring period, the sensor monitor is turned off in step 254, the motor 219 is stopped in step 256 and the clutch system of the clutch-brake unit 228 is disengaged in step 258 successively. Then, the alarm lamp is lighted up and an alarm information is displayed in step 260. After the causes of the abnormal condition have been removed, the foregoing control procedures are started again.

Thus, in the second embodiment, the dislocation of the electromagnet holder 212 from the correct seating position of the positioning block 213 is corrected automatically to enable the work following apparatus to start the work following operation automatically without requiring any manual work for correcting the dislocation of the electromagnet holder 212 from the correct seating position at the start of the work following operation, so that operator's work is reduced remarkably and perfectly automatic press working is possible.

Third Embodiment

The third embodiment is substantially the same in constitution and function as the first and second embodiments, except that further improvements in construction and components are incorporated therein.

Figure 17:
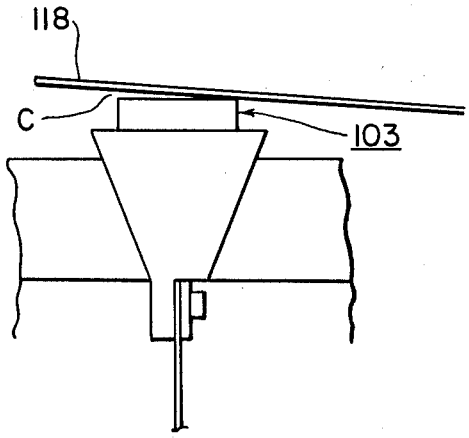
FIG. 17 is a fragmentary view showing an undesirable position of a work relative to the electromagnet of the work following apparatus in the first embodiment.
Figure 18:
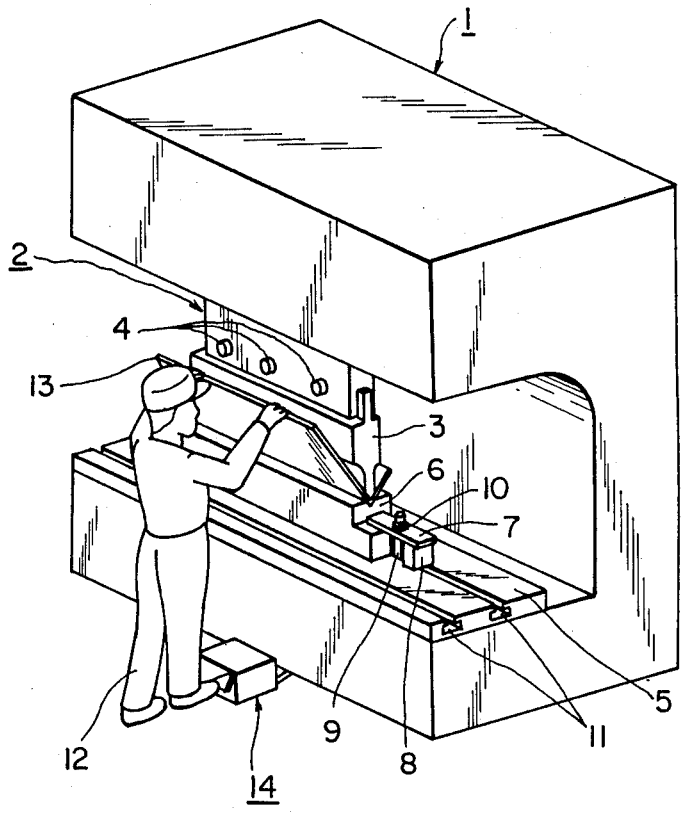
FIG. 18 (PRIOR ART)
FIG. 18 is a general perspective view of assistance in explaining the conventional manner of bending press working, showing the general configuration of a bending press.
Figure 19:
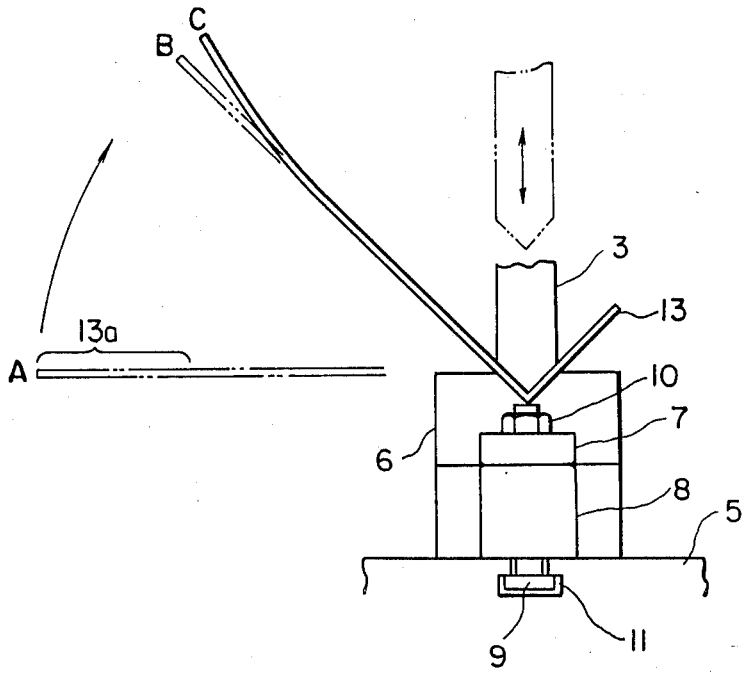
FIG. 19 is an illustration of assistance in explaining the undesirable behavior of a work as bent on a bending press.

As shown in FIG. 17, a work 118 placed on the work supporting table is tilted, in some cases, relative to the attracting surface of the core 103 of the work holding assembly with a gap C diminishing the effective attraction of the electromagnet exerted on the work. Furthermore, the frictional resistance of the drum case against the unwinding movement of the spring plate possibly separates the work holding assembly from the work when the work holding assembly moves upward together with the work.

The third embodiment incorporates further improvements to obviate such undesirable conditions.

Figure 9:
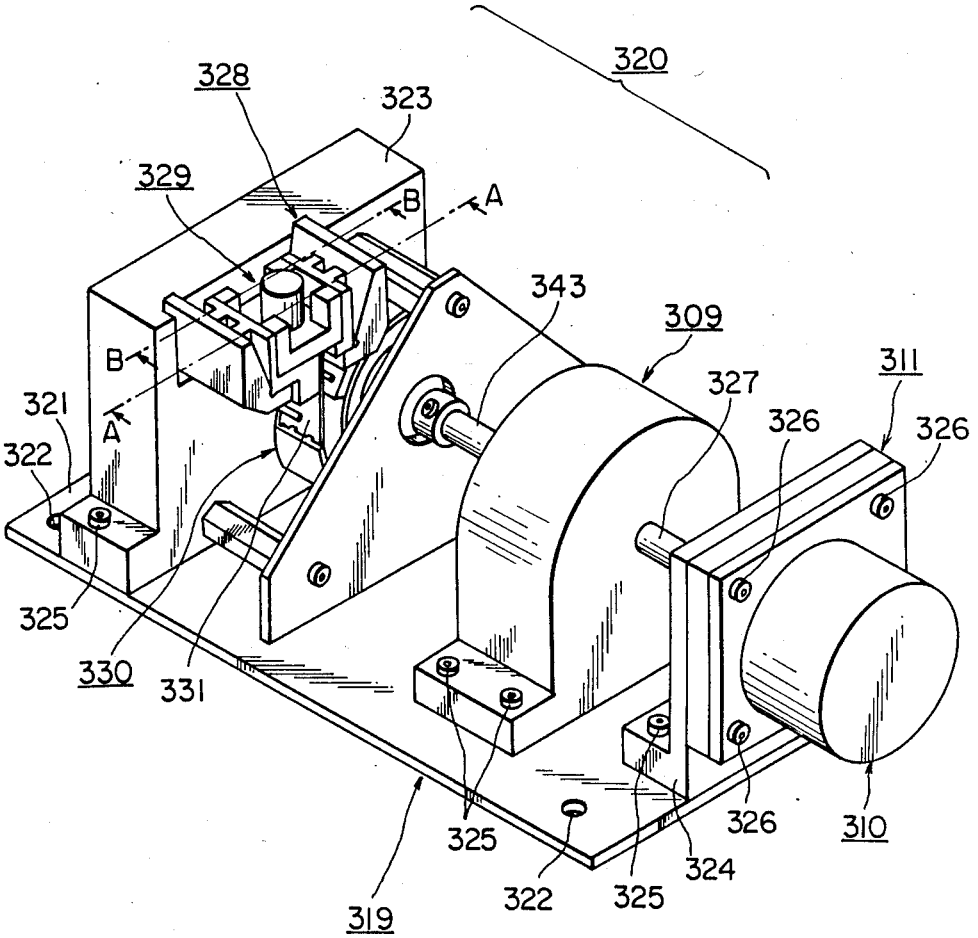
FIG. 9 is a perspective view of a work following apparatus, in a second embodiment, according to the present invention.

Referring to FIG. 9, mounted on and fixed with bolts 325 to a base plate 321 are the main block 323 of a work following mechanism 320, an electromagnetic clutch 309 a bracket 324. A motor 310 and a reduction gear 311 are fastened to the bracket 324 with bolts 326A shaft 327 extending between the reduction gear 311 and the electromagnetic clutch 309 has one end connected to the electromagnetic clutch 309 and the other end connected to the output shaft of the reduction gear 311. A work holding assembly positioning unit 328 and a work following unit 330 are mounted on the main block 323 of the work following mechanism 320. A work holding assembly 329 is received in the work holding assembly positioning unit 328. A spring plate 331, namely, a work following member, extends between the work holding assembly 329 and the work following unit 330.

Figure 11:
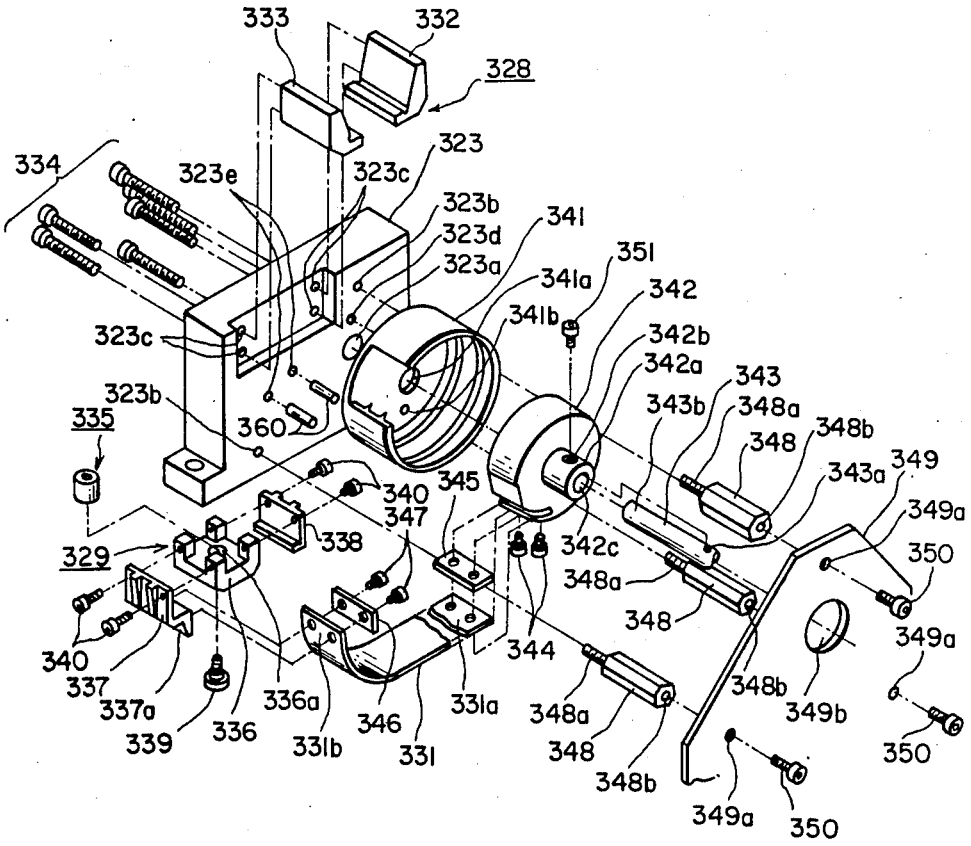
FIG. 11 is an exploded perspective view of the work following apparatus of FIG. 9.
Figure 12:
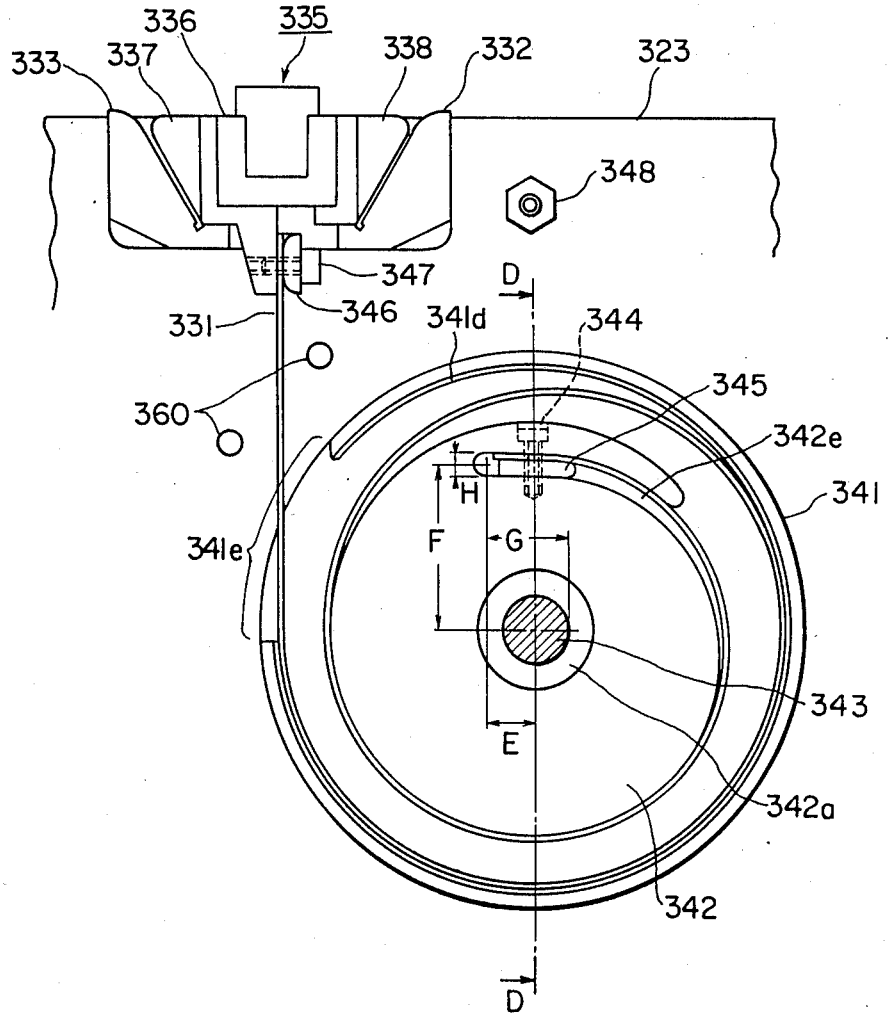
FIG. 12 is a sectional view taken on line A—A in FIG. 9.
Figure 13:
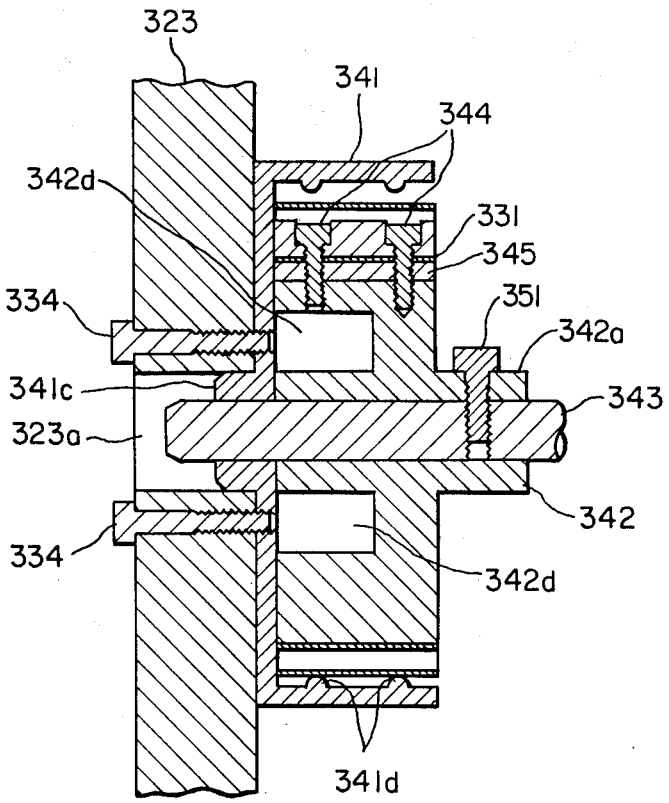
FIG. 13 is a sectional view taken on line D—D in FIG. 12.

Referring to FIG. 11, the work holding assembly positioning unit 328 has positioning blocks 332 and 333 secured to the main block 323 with bolts 334 inserted in holes **323*c* formed in the main block 323. Guide members 360 for guiding the spring plate 331 are driven into holes 323*e* formed in the side wall of the main block 323. The work following unit 330 includes a drum case 341 having a side wall provided with a central hole 341*a*, threaded holes 341*b* distributed in point symmetry with respect to the central hole 341*a*, and a boss 341*c* (FIG. 13), and a circumferential wall provided with annular protrusions in the inside surface thereof (FIG. 13) and a recess 341*e* (FIG. 12) for passing the spring plate 331 therethrough. As shown in FIG. 13, the drum case 341 is fastened to the main block 323 with the boss 341*c* fitted in a hole 323*a* formed in the main block 323 with bolts 334 inserted through bolt holes 323*d* and screwed in the threaded holes 341*b* of the drum case 341. As shown in FIGS. 11, 12 and 13, a drum 342 has a boss 342*a* provided with a central bore 342*c*, and a recess 342*d* (FIG. 13) for reducing the weight. A spiral groove 342*e* of H in width and a depth slightly greater than the width of the spring plate 331 is formed in the drum 342 so as to extend from a point separated from the center of the drum 342 by a distance E along a diameter and by a distance F along another diameter perpendicular to the former and to merge into the circumference of the drum 342. On end 331*a* of the spring plate 331 and a plate 345 are inserted in the bottom of the spiral groove 342*e* and are fastened to the drum 342 with bolts 344. The work holding assembly 329 includes an electromagnet 335 and a floating stem 339 screwed in the electromagnet 335. The floating stem 339 is inserted from the under side of a holding member 336 through a hole 336*a* formed in the holding member 336, and then screwed in the electromagnet 335 to join the electromagnet to the holding member 336. Slide blocks 337 and 338 are fixed to the holding member 336 with bolts 340. The other end 331*b* of the spring plate 331 and a plate 346 are fixed to the lower end of the slide block 337 with bolts 347. One end 343*b* of a shaft 343 is inserted in the central bore 342*c* of the drum 342 and the central hole 341*a* of the drum case 341. The other end of the shaft 343 is inserted in a hole 349*b* formed in a cover plate 349. The drum 342 is fixed to the shaft 343 with a bolt 351 inserted through a hole 342***b* formed in the boss 342*a* thereof and screwed in a threaded hole 343*a* formed in the end 343*b* of the shaft 343. The spring plate 331 is wound on the drum 342 to seat the work holding assembly 329 on the work holding assembly positioning unit 328. The shaft 343 is coupled at the other end thereof with the output shaft of the electromagnetic clutch 309. Spacing bars 348 are fixed to the main block 323 by screwing the respective threaded ends 348*a* thereof in threaded holes 323*b* formed in the main block 323, and then the cover plate 349 is fixed to the spacing bars 348 by screwing bolts 350 in threaded holes 348*b* formed in the free ends of the spacing bars 348, respectively, through holes 349*a* formed in the cover plate 349.

Figure 14:
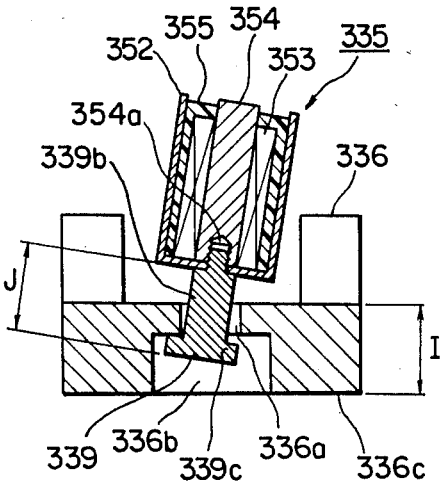
FIG. 14 is a sectional view taken on line B—B in FIG. 9.

Referring to FIG. 14 showing the essential portion of the work holding assembly 329, the electromagnet 335 is formed by placing a coil 353 and a core 354 in a case 352, fixing the core 354 to the case 352 by screwing the threaded position of the floating stem 339 in a threaded hole 354*a* formed in the core 354, and filling the case 352 with a molding material 355. After the molding material 355 has solidified, the floating stem 339 is removed from the electromagnet 335, and then the floating stem 339 is passed through the central hole 336*a* of the holding member 336 to be screwed in the core 354 again to join the work holding assembly 329 to the holding member 336. The diameter of the hole 336*a* of the holding member 336 is greater than the outside diameter of the stem portion of the floating stem 339 and is smaller than the outside diameter of the head of the floating stem 339, and the thickness I of the wall of the holding member 336 having the hole 336*a* is slightly greater than the length J of a portion of the floating stem 339 projecting from the outer surface of the bottom wall of the case 352. A counterbore 336*b* is formed in the holding member 336 concentrically with the hole 336*a* to allow the free movement of the head 339*c* of the floating stem 339. Thus, the work holding assembly 329 is able to move relative to the holding member 336 within a limited range.

The manner of operation of the third embodiment will be described hereinafter with reference to FIGS. 9, 10, 12, 13 and 14.

Figure 10:
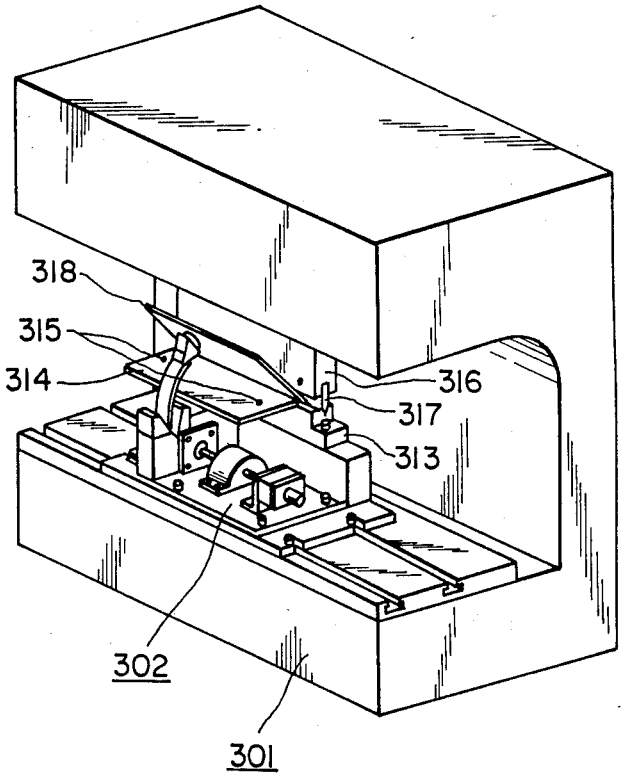
FIG. 10 is a perspective view showing the disposition of a work following apparatus embodying the present invention on a bending press.

As shown in FIG. 10, the work following apparatus 319 is fixedly mounted on the bed of a bending press 301 having a movable bending die 317 fixed to the ram, a fixed bending die 313 fixedly mounted on a die holder, and a work supporting table 314. A work 318 such as a flat plate is positioned on the work supporting table 314. If the work 318 is tilted relative to the attracting surface of the electromagnet 335 of the work holding assembly 329, the electromagnet 335 is able to hold to the work 318, because the floating stem 339 is movable relative to the holding member 336. After the electromagnet 335 has held to the work 318, the movable bending die 317 is lowered to bend the work 318. Then, the work holding assembly 329 rises together with the free side of the work 318 as the work 318 is bent. A frictional resistance of the drum case 341 acting on the spring plate 331 against the upward movement of the work holding assembly 329 tends to separate the electromagnet 335 from the work 318.

However, since the annular protrusions 341*d* formed in the inside surface of the circumferential wall of the drum case 341 as shown in FIG. 13 and the spring plate 331 is drawn out from the drum case 341 tangentially as shown in FIG. 12, the frictional resistance of the drum case 341 is unvariable and is limited to a moderate level high enough to apply a sufficient resistance to the spring plate 331 to prevent the work 318 from warping in the final stage of the bending press working. Although the weight of the work 318 tends to cause the spring plate 331 flex outward after the movable bending die 317 has been raised, the guide members 360 prevent the spring plate 331 from bending outward, so that the work holding assembly 329 moves downward together with the work 318 until the work 318 is restored to the correct position on the work supporting table 314 defined by the positioning pins 315.

Fourth Embodiment

Figure 15:
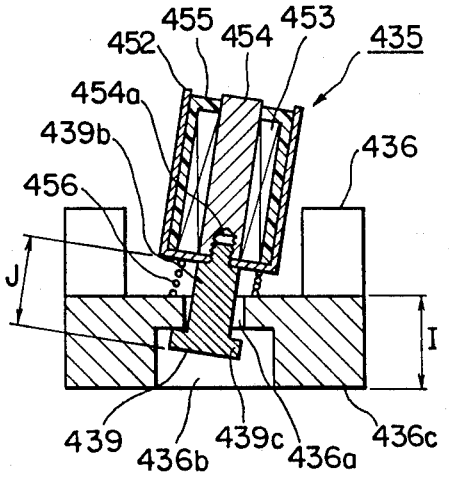
FIG. 15 is a sectional view, similar to FIG. 14, showing a mechanism for supporting an electromagnet, employed in a third embodiment of the present invention.

The fourth embodiment is different from the third embodiment only in the construction of the work holding assembly 329. As shown in FIG. 15, the work holding assembly 435 of the fourth embodiment further comprises a compression spring 456. The rest of the components and the construction of the work holding assembly 429 of the fourth embodiment are the same as those of the third embodiment.

Referring to FIG. 15, the work holding assembly 429 comprises a core 454, a coil 453 mounted on the core 454, a case 452 accommodating the core 454 and the coil 453, a molding material 455 filled in the case 452, a floating stem 439, and the compression spring 456. The compression spring 456 is interposed between the bottom wall of the case 452 and a holding member 436. The compression spring 456 prevents the collision of the work holding assembly 429 against the holding member 436 when the work holding assembly 429 is in a free state.

Fifth Embodiment

Figure 16:
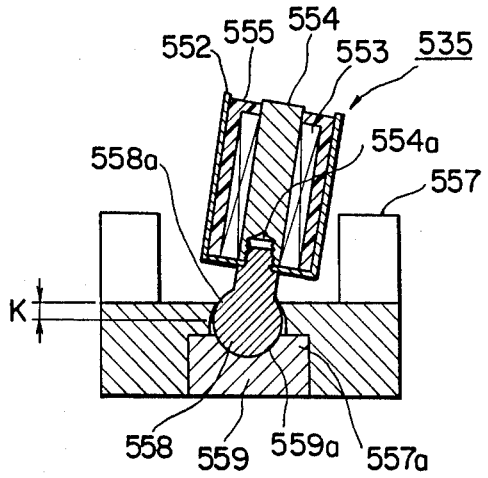
FIG. 16 is a sectional view, similar to FIG. 14, showing a mechanism for supporting an electromagnet, employed in a fourth embodiment of the present invention.

The fifth embodiment, as shown in FIG. 16, is different from the third embodiment only in the construction of the work holding assembly 329. The work holding assembly 529 of the fifth embodiment comprises a core 554, a coil 553 mounted on the core 554, a case 552 accommodating the core 554 and the coil 553, a molding material 555 filled in the case 552, and a stem 558 having a spherical head 558*a* and a threaded end screwed in the threaded hole 554*a* of the core 554. A holding member 557 has a central spherical hole to receive the spherical head 558*a* of the stem 558, and a member 559 having a spherical recess in the central portion thereof and fitted in a counterbore 557*a* formed in the holding member 557 so as to support the spherical head 558*a* of the stem 558. The spherical head 558*a* of the stem 558, the spherical hole of the holding member 557 and the member 559 form a ball-and-socket joint allowing the rotary motion of the stem 558 in every direction within certain limits. The function of the work holding assembly 529 of the fifth embodiment is the same as those of the work holding assemblies of the third and fourth embodiments, and hence the description thereof will be omitted.

As apparent from the foregoing description, according to the present invention, the work holding assembly of the work following apparatus holds surely to the work and follows the movement of the work throughout the bending press working, so that the work is held satisfactorily, whereby the undesirable warping of the work in the final stage of the bending process is prevented.

Although the invention has been described in its preferred forms with a certain degree of particularity, as many apparently widely different embodiments of the present invention may be made without departing from the spirit and scope thereof, it is to be understood that the invention is not limited to the specific embodiments thereof except as defined in the appended claims.

What is claimed is:

1. A work following apparatus for controlling the movement of the free portion of a work during a press working process to prevent the free portion of the work from warping and for restoring the work to its initial position after the same has been pressed, which comprises:

a base plate to be fixed to the bed of a press brake;

a drum case fixedly disposed at one end of said base plate;

a work holding means which holds to the free portion of a work positioned on the work supporting table of the press brake and moves together with the free portion of the work during the press working process;

a work holding means holding member fixedly holding said work holding means;

a positioning block fixedly mounted on said drum case so as to receive said work holding means holding member thereon to position said work holding means holding member at a predetermined seating position;

a drum rotatably supported within said drum case;

an elongate elastic member having one end fixed to said work holding means holding member, and the other end fixed to the circumference of said drum, and wound on said drum;

a shaft extending concentrically with said drum and having one end fixedly mounted with said drum;

a clutch means having an output member fixedly connected to the other end of said shaft;

a bracket fixed to said base plate;

a reduction gear fixed to said bracket and having an output shaft connected to the input member of said clutch means;

a motor fixed through said reduction gear to said bracket and having an output shaft connected to the input shaft of said reduction gear;

a sensor provided on said positioning block to detect the arrival of said work holding means holding member at the seating position; and a control unit including a microcomputer which controls said work holding means, said clutch means and the press brake in accordance with a control program, and an interface which receives external detection signal, gives signals corresponding to the external signals to the microcomputer and transmits command signals provided by the microcomputer to circuits respectively for driving said work holding means, said clutch means and the press brake.

2. A work following apparatus according to claim 1, wherein said shaft is connected to the output member of said clutch means by a safety coupling which breaks or yields when an excessive torque is applied thereto.

3. A work following apparatus according to claim 1, wherein the input member of said clutch means is connected to the output shaft of said reduction gear by a safety coupling which breaks or yields when an excessive torque is applied thereto.

4. A work following apparatus according to claim 1, wherein said work holding means is an electromagnet.

5. A work following apparatus according to claim 1, wherein said elongate elastic member is an elongate spring plate.

6. A work following apparatus according to claim 1, wherein said work holding means holding member is formed in the shape of a wedge, and said positioning block is provided with a wedge-shaped recess corresponding to said work holding means holding member.

7. A work following apparatus according to claim 1, wherein said control unit further controls an industrial robot for feeding the work to the press brake and removing the pressed work from the press brake.

8. A work following apparatus according to claim 1, wherein said sensor is a refrective photoelectric sensor.

9. A work following apparatus for controlling the movement of the free portion of a work during a press working process to prevent the free portion of the work from warping and for restoring the work to its initial position after the same has been pressed, which comprises:

a base plate to be fixed to the bed of a press brake;

a drum case fixedly disposed at one end of the base plate;

a work holding means which holds to the free portion of a work positioned on the work supporting table of the press brake and moves together with the free portion of the work during the press working process;

a work holding means holding member fixedly holding said work holding means;

a positioning block fixedly mounted on said drum case so as to receive said work holding means holding member thereon to position said work holding means holding member at a predetermined seating position;

a drum rotatably supported within said drum case;

an elongate elastic member having one end fixed to said work holding means holding member and the other end fixed to the circumference of said drum, and wound on said drum;

a shaft extending concentrically with said drum and having one end fixedly mounted with said drum;

a clutch-brake means having an output member fixedly connected to the other end of said shaft;

a bracket fixed to said base plate;

a reduction gear fixed to said bracket and having an output shaft connected to the input member of said clutch-brake means;

a motor fixed through said reduction gear to said bracket and having an output shaft connected to the input shaft of said reduction gear;

sensing means provided on said positioning block to detect the arrival of said work holding means holding member at the seating position on said positioning block; and a control unit including a microcomputer which controls said work holding means, said clutch-brake means and the press brake in accordance with a control program, and an interface which receives external detection signals, gives signals corresponding to the external detection signals to the microcomputer, and transmits command signals provided by the microcomputer to circuits respectively for driving said work holding means, said clutch-brake means and the press brake.

10. A work following apparatus according to claim 8, wherein said shaft is connected to the output member of said clutch-brake means by a safety coupling which breaks or yields when an excessive torque is applied thereto.

11. A work following apparatus according to claim 8, wherein the input member of said clutch-brake means is connected to the output shaft of said reduction gear by a safety coupling which breaks or yields when an excessive torque is applied thereto.

12. A work following apparatus according to claim 8, wherein said work holding means is an electromagnet.

13. A work following apparatus according to claim 8, wherein said elongate elastic member is an elongate spring plate.

14. A work following apparatus according to claim 8, wherein said clutch-brake means comprises a clutch system and a brake system, the clutch system is disengaged when the brake system is applied, and the brake system is released when the clutch system is engaged.

15. A work following apparatus according to claim 8, wherein said work holding means holding member is formed in the shape of a wedge, and said positioning block is provided with a wedge-shaped recess corresponding to said work holding means holding member.

16. A work following apparatus according to claim 8, wherein said control unit further controls an industrial robot for feeding the work to the press brake and removing the pressed work from the press brake.

17. A work following apparatus according to claim 9, wherein said sensor is a refrective photoelectric sensor.

18. A work following apparatus for controlling the movement of the free portion of a work during a press working process to prevent the free portion of the work from warping and for restoring the work to its initial position after the same has been pressed, which comprises:

a base plate to be fixed to the bed of a press brake;

a main block fixedly disposed at one end of said base plate;

a working holding means which holds to the free portion of a work positioned on the work supporting table of the press brake and moves together with the free portion of the work during the press working process;

a work holding means holding member holding said work holding means so that said work holding means is able to rotate in every direction within certain limits;

a positioning unit fixed to the side of said main block so as to receive said work holding means holding member at a seating position thereon for positioning;

a drum case fixed to the side of said main block, and provided in the inside surface of the circumferential wall thereof with annular protrusions;

a drum rotatably supported within said drum case concentrically with said drum case;

an elongate elastic member having one end fixed to the lower end of said work holding means holding member and the other end fixed to the circumference of said drum, and wound on said drum so as to be drawn out tangentially of said drum case in a vertical direction through a recess formed in the circumferential wall of said drum case;

guide members attached to the side of said main block near the recess formed in the circumferential wall of said drum case so as to guide said elongate elastic member in vertical directions;

a cover plate disposed opposite to the side of said main block with said drum case therebetween and supported on said main block with spacing bars;

a clutch means fixedly disposed on said base plate coaxially with said drum, and having an output member fixedly connected to a shaft rotatably supporting said drum;

a bracket fixed to said base plate;

a reduction gear secured to said bracket, and having an output shaft connected to the input member of said clutch means; and a motor for driving said drum, secured through said reduction gear to said bracket, and having an output shaft coaxially connected to the input shaft of said reduction gear.

19. A work following apparatus according to claim 16, wherein said work holding means comprises: an electromagnet including a core having a threaded hole at one end thereof, and a coil wound on the core; a case accommodating the electromagnet with the end provided with the threaded hole of the core seated on the bottom wall thereof; a molding material filling the case; and a connecting member having a stem portion, a head formed at one end of the stem portion and a threaded portion formed at the other end of the stem portion, the threaded portion of the connecting member is screwed in the threaded hole of said core to join the electromagnet and the connecting member fixedly, a hole having a diameter greater than that of the stem portion of the connecting member and smaller than that of the head of the connecting member is formed in the bottom wall of said work holding means holding member, a recess for receiving the head of the connecting member is formed in the underside of the work holding means holding member, the threaded portion and stem portion of the connecting member is passed from below the bottom wall of said work holding means holding member through the hole formed in the bottom wall of the same so that the head of the connecting member is located in the recess formed in the underside of the bottom wall of said work holding means holding member and then the connecting member is screwed in the threaded hole of the core to enable the work holding means to rotate on the bottom wall of said work holding means holding member in every direction within certain limits.

20. A work following apparatus according to claim 17, wherein the head of said connecting member is formed integrally and coaxially with the stem portion in the shape of a circular disk, and the hole formed in the bottom wall of said work holding means holding member is cylindrical.

21. A work following apparatus according to claim 18, wherein a compression spring is operatively interposed between the bottom wall of said case and the upper surface of the bottom wall of said work holding means holding member.

22. A work following apparatus according to claim 17, wherein the head of said connecting member is formed integrally with the stem portion in a spherical shape, the hole formed in the bottom wall of said work holding means holding member has a spherical surface, a member having a spherical recess in one major surface thereof is fitted fixedly in the recess formed in the underside of the bottom wall of said work holding means holding member with the major surface having the spherical recess opposite the underside of the bottom wall of said work holding means holding member, and head of said connecting member is received slidably in a spherical space defined by the spherical surface of the hole formed in the bottom wall of said work holding means holding member and the spherical recess formed in the member fixedly fitted in the recess formed in the underside of the bottom wall of said work holding means holding member to enable said work holding means to rotate in every direction within certain limits.

23. A work following apparatus according to claim 16, wherein said elongate elastic member is an elongate spring plate.

24. A work following method for controlling the movement of the free portion of a work during press working process to prevent the free portion of the work from warping and for restoring the work to its initial position after the same has been pressed by using a work following apparatus comprising: a base plate fixed to the bed of the press brake; a drum case fixedly disposed at one end of said base plate; a work holding means which holds to the free portion of a work positioned on the work supporting table of the press brake and moves together with the free portion of the work during the press working process; a work holding means holding member fixedly holding said work holding means; a positioning block fixedly mounted on said drum case so as to receive said work holding means holding member thereon to position said work holding means holding member at a predetermined seating position; a drum rotatably supported within said drum case; an elongate elastic member having one end fixed to said work holding means holding member, and the other end fixed to the circumference of said drum, and wound on said drum; a shaft extending concentrically with said drum and having one end fixedly mounted with said drum, a clutch means having an output member fixedly connected to the other end of said shaft, a bracket fixed to said base plate, a reduction gear fixed to said bracket and having an output shaft connected to the input member of said clutch means; a motor fixed through said reduction gear to said bracket and having an output shaft connected to the input shaft of said reduction gear; a sensor provided on said positioning block to detect the arrival of said work holding means holding member at the seating position; and a control unit including a microcomputer which controls said work holding means, said clutch means, the press brake and an industrial robot in accordance with a control program, and an interface which receives external detection signals, gives signals corresponding to the external signals to the microcomputer and transmits command signals provided by the microcomputer to circuits respectively for driving said work holding means, said clutch means and the press brake, said work following method comprising steps of:

connecting the press brake, the work following device and the industrial robot to a power source;

starting the control program to actuate the robot for feeding a work to the press brake;

energizing the work holding means so as to hold to the work upon the detection of placement of the work at a predetermined position on the press;

lowering the ram of the press brake to press the work between the movable die secured to the ram and a fixed die fixed to the bed of the press brake;

allowing the work holding member to follow the movement of the free portion of the work as the work is pressed;

raising the movable die after the movable die has been kept at the lowermost position for a predetermined time;

engaging the clutch means upon the detection of the arrival of the movable die at the uppermost position so that the drum is rotated to wind an elongate elastic member gradually on the drum;

disengaging the clutch means upon the detection of the arrival of the work holding means holding member at the seating position on the positioning member by the sensor to stop the rotation of the drum;

actuating the industrial robot to transfer the pressed work from the press brake to a predetermined position; and returning the industrial robot to its home position.

25. A work following method for controlling the movement of the free portion of a work during a press working process to prevent the free portion of the work from warping and for restoring the work to its initial position after the same has been pressed, by means of a work following apparatus comprising: a base plate fixed to the bed of the press brake; a drum case fixedly disposed at one end of the base plate; a work holding means which holds to the free portion of a work positioned on the work supporting table of the press brake and moves together with the free portion of the work during the press working process; a work holding means holding member fixedly holding said work holding means; a positioning block fixedly mounted on said drum case so as to receive said work holding means holding member thereon to position said work holding means holding member at a predetermined seating position; a drum rotatably supported within said drum case; an elongate elastic member having one end fixed to said work holding means holding member and the other end fixed to the circumference of said drum, and wound on said drum; a shaft extending concentrically with said drum and having one end fixedly mounted with said drum; a clutch-brake means having an output member fixedly connected to the other end of said shaft, and having a clutch system and a brake system which operate alternately; a bracket fixed to said base plate; a reduction gear fixed to said bracket and having an output shaft connected to the input member of said clutch-brake means; a motor fixed through said reduction gear to said bracket and having an output shaft connected to the input shaft of said reduction gear; sensing means provided on said positioning block to detect the arrival of said work holding means holding member at the seating position on said positioning block; and control unit including a microcomputer which control said work holding means, said clutch-brake means, the press and an industrial robot in accordance with a control program, and an interface which receives external detection signals, gives signals corresponding to the external detection signals to the microcomputer, and transmits command signals provided by the microcomputer to circuits respectively for driving said work holding means, said clutch-brake means, the press brake and the industrial robot, said work following method comprising:

deciding whether or not the work holding means holding member is seated correctly at a predetermined seating position on the positioning block through the detection signal provided by the sensing means;

applying the brake system of the clutch-brake unit and starting the press for press working when the work holding means holding member is seated correctly at the seating position on the positioning block;

engaging the clutch system of the clutch-brake unit when the work holding means holding member is not positioned correctly at the seating position on the positioning block;

starting the motor and starting detection signal monitoring operation to wind the elastic member further on the drum to position the work holding means holding member correctly at the seating position on the positioning block;

deciding whether or not the sensing means has provided a detection signal within a predetermined monitoring time;

stopping the detection signal monitoring operation when a detection signal is provided by the sensing means;

simultaneously stopping the motor, disengaging the clutch system of the clutch-brake unit and applying the clutch system of the clutch-brake unit; and starting press for press working.

* * * * *